US011713739B1

(12) United States Patent
Greenawalt

(10) Patent No.: US 11,713,739 B1
(45) Date of Patent: Aug. 1, 2023

(54) METHOD AND SYSTEM FOR INTERNAL COMBUSTION ENGINE FLUID FLOW

(71) Applicant: PRL MOTORSPORTS LLC, Export, PA (US)

(72) Inventor: Jason R. Greenawalt, Greensburg, PA (US)

(73) Assignee: PRL Motorsports, LLC, Export, PA (US)

( * ) Notice: Subject to any disclaimer, the term of this patent is extended or adjusted under 35 U.S.C. 154(b) by 0 days.

(21) Appl. No.: 17/953,963

(22) Filed: Sep. 27, 2022

(51) Int. Cl.
*F02M 37/00* (2006.01)

(52) U.S. Cl.
CPC .... *F02M 37/0017* (2013.01); *F02M 37/0047* (2013.01)

(58) Field of Classification Search
CPC ..... F02M 37/0017; F02M 37/0047
See application file for complete search history.

(56) References Cited

U.S. PATENT DOCUMENTS 4,789,098 A * 12/1988 Shepherd ..... B60H 1/00007 123/557
5,360,034 A * 11/1994 Der Manuelian .... B60K 15/077 137/561 A
7,481,919 B1 * 1/2009 Keenan ..... F02M 37/40 210/167.31
11,519,369 B1 * 12/2022 Dupre ..... F02M 37/0094
2007/0227504 A1 * 10/2007 Carroll ..... F01N 3/2066 123/446

* cited by examiner

*Primary Examiner* — Hung Q Nguyen
(74) *Attorney, Agent, or Firm* — Dentons Cohen & Grigsby P.C.

(57) ABSTRACT

Systems, methods, and a kit of two diverter blocks are provided for diverting a fluid from a fluid line and directing the fluid through a sensor. Fluid flows into a first a first diverter block and into a sensor before flowing out of the sensor and into a second diverter block, then into a downstream fluid line.

20 Claims, 17 Drawing Sheets

SECTION A-A
SCALE 1

SECTION B-B
SCALE 1 : 1

METHOD AND SYSTEM FOR INTERNAL COMBUSTION ENGINE FLUID FLOW

FIELD OF INVENTION

This invention generally relates to the field of internal combustion engines, and in particular, systems and methods to redirect the flow of fuel in a fuel line of internal combustion engines.

BACKGROUND

Combustion engine systems are commonly used to power vehicles and other machines. In some examples, a combustion engine system comprises a fuel storage system, an internal combustion engine, a fuel injection system for introduction of fuel into the engine, a catalytic converter and an exhaust system. The fuel line of combustion engines may include one or more sensors, such as flowmeters and temperature sensors, among others. Conventional approaches to install aftermarket fuel sensors along the fuel line may require disconnecting and/or cutting the fuel lines of the original equipment manufactured (OEM) engines and installing an external fuel line that includes or pass through the sensor. For example, the external fuel line may be connected to a first end of an open OEM fuel line and a second end of the open OEM fuel line. The aftermarket sensor may be positioned intermediate the first end and second end of the open OEM fuel line. Additionally, due to ever increasingly cramped engine compartments, retrofitting and adding new or modified components to a fuel system has become increasingly challenging. Such conventional approaches may suffer from one or more of the following limitations: relatively difficult to install, low reliability (e.g., ethanol in the fuel line may damage the lines construction), leaking at the connection points, and ethanol in the fuel line may damage the fuel line such that the fuel line does not provide sufficient direct structural support to the sensor which may cause the sensor's orientation to change over time. Fuel line degradation from ethanol-based fuels may also damage further downstream fuel injection system components in modern fuel injected vehicles. Accordingly, more efficient and reliable methods and systems to redirect the flow of fuel in a fuel line of internal combustion engines through a sensor may be desirable.

DESCRIPTION OF THE DRAWINGS

The present invention described herein may be better understood by reference to the accompanying drawing sheets, in which.

DETAILED DESCRIPTION

Figure 1:
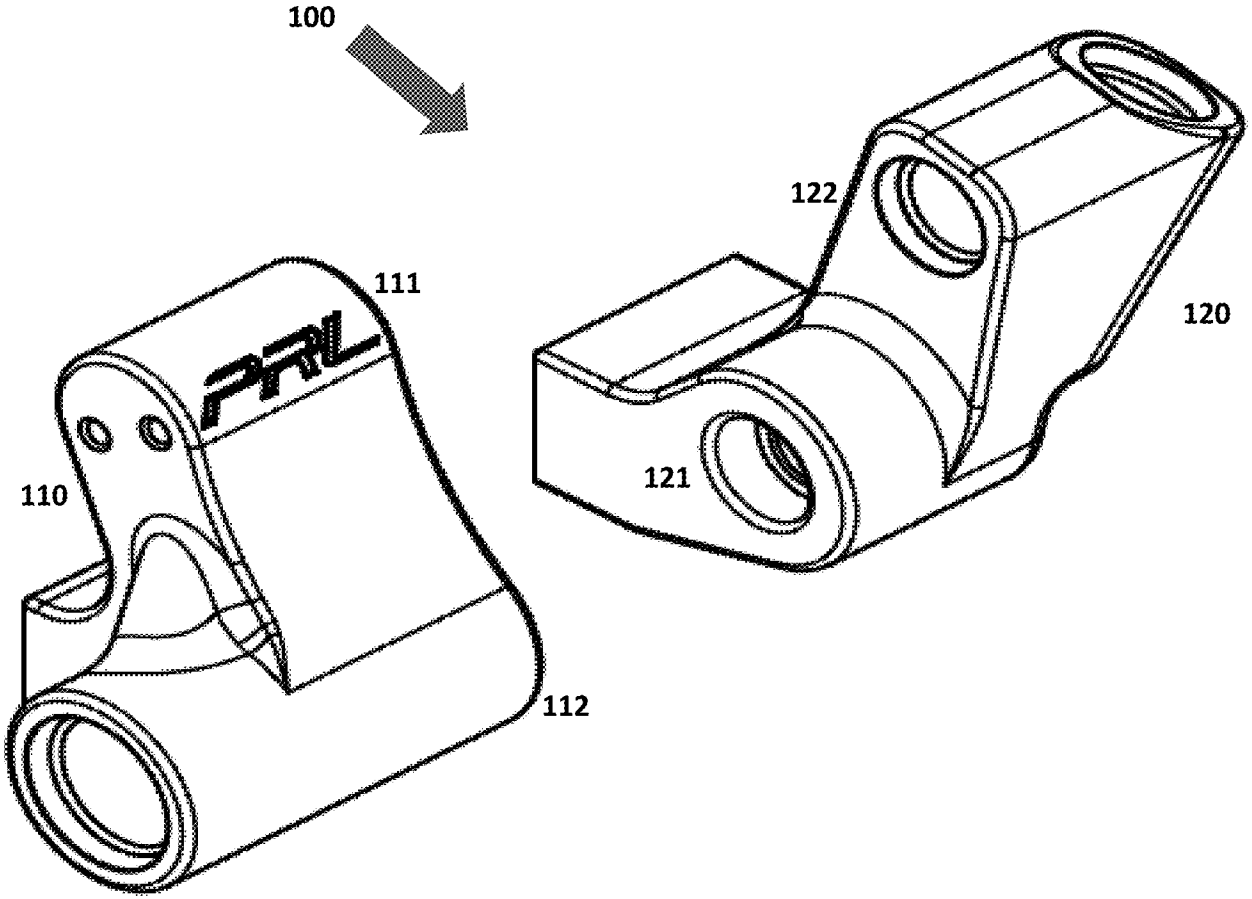
FIG. 1 includes a front perspective exploded view of a system for redirecting a flow of a fluid according to the present invention.

This disclosure generally describes systems and methods of making and using a fuel diverter block. It is understood, however, that this disclosure also embraces numerous alternative features, aspects, and advantages that may be accomplished by combining any of the various features, aspects, and/or advantages described herein in any combination or sub-combination that one of ordinary skill in the art may find useful. Such combinations or sub-combinations are intended to be included within the scope of this disclosure. As such, the claims may be amended to recite any features, aspects, and advantages expressly or inherently described in, or otherwise expressly or inherently supported by, this disclosure. Further, any features, aspects, and advantages that may be present in the prior art may be affirmatively disclaimed. Accordingly, this disclosure may comprise, consist of, consist essentially or be characterized by one or more of the features, aspects, and advantages described herein. As used herein, the term "and/or" includes any and all combinations of one or more of the associated listed items.

All numerical quantities stated herein are approximate, unless stated otherwise. Accordingly, the term "about" may be inferred when not expressly stated. The numerical quantities disclosed herein are to be understood as not being strictly limited to the exact numerical values recited. Instead, unless stated otherwise, each numerical value stated herein is intended to mean both the recited value and a functionally equivalent range surrounding that value. At the very least, and not as an attempt to limit the application of the doctrine of equivalents to the scope of the claims, each numerical value should at least be construed in light of the number of reported significant digits and by applying ordinary rounding processes. Typical exemplary degrees of error may be within 20%, 10%, or 5% of a given value or range of values. Alternatively, the term "about" refers to values within an order of magnitude, potentially within 5-fold or 2-fold of a given value. Notwithstanding the approximations of numerical quantities stated herein, the numerical quantities described in specific examples of actual measured values are reported as precisely as possible. Any numerical values, however, inherently contain certain errors necessarily resulting from the standard deviation found in their respective testing measurements.

All numerical ranges stated herein include all sub-ranges subsumed therein. For example, a range of "1 to 10" or "1-10" is intended to include all sub-ranges between and including the recited minimum value of 1 and the recited maximum value of 10 because the disclosed numerical ranges are continuous and include every value between the minimum and maximum values. Any maximum numerical limitation recited herein is intended to include all lower numerical limitations. Any minimum numerical limitation recited herein is intended to include all higher numerical limitations.

In the following description, certain details are set forth in order to provide a better understanding of various features, aspects, and advantages the invention. However, one skilled in the art will understand that these features, aspects, and advantages may be practiced without these details. In other instances, well-known structures, methods, and/or processes associated with methods of practicing the various features, aspects, and advantages may not be shown or described in detail to avoid unnecessarily obscuring descriptions of other details of the invention.

The terminology used herein is for the purpose of describing particular examples only and is not intended to be limiting. As used herein, the singular forms "a", "an", and "the" may be intended to include the plural forms as well, unless the context clearly indicates otherwise. The terms "comprises", "comprising", "including", "having", and "characterized by", are inclusive and therefore specify the presence of stated features, elements, compositions, steps, integers, operations, and/or components, but do not preclude the presence or addition of one or more other features, integers, steps, operations, elements, components, and/or groups thereof. Although these open-ended terms are to be understood as a non-restrictive term used to describe and claim various aspects set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, described herein also specifically includes embodiments consisting of, or consisting essentially of, such recited compositions, materials, components, elements, features, integers, operations, and/or process steps. In the case of "consisting of", the alternative embodiment excludes any additional compositions, materials, components, elements, features, integers, operations, and/or process steps, while in the case of "consisting essentially of", any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

The diverter block according to the present invention may provide a more cost-effective and/or efficient system and method install an external (e.g., non-OEM) sensor in line with a fuel line. The present invention may not require the addition of any external fuel lines when it intercepts the OEM line at its original OEM connection points. This may reduce and/or eliminate a common source of failure and wear when conventional aftermarket lines are used. The diverter block according to the present invention may provide rigid structural to support the sensor and hold it in a predetermined area along the fluid flow path. The diverter block according to the present invention may be constructed from materials that are more resistant to corrosion from ethanol and/or ethanol-based fuels, such as aluminum, for example.

According to some aspects, the diverter block system may be configured to fit into the space and/or dimensions of the original and/or OEM engine system with minimal or no alternations to the original and OEM engine system, respectively. According to some aspects, the dimensions of the OEM engine system before installation of the diverter block system may be similar to the dimensions of the OEM engine system after installation of the diverter block system. According to some aspects, the dimensions of the OEM engine system before installation of the diverter block system may be substantially similar to the dimensions of the OEM engine system after installation of the diverter block system. According to some aspects, the dimensions of the OEM engine system before installation of the diverter block system may be essentially similar to the dimensions of the OEM engine system after installation of the diverter block system. According to some aspects, the dimensions of the OEM engine system before installation of the diverter block system may be completely similar to the dimensions of the OEM engine system after installation of the diverter block system. According to some aspects, the dimensions of the OEM engine system before installation of the diverter block system may be the same as the dimensions of the OEM engine system after installation of the diverter block system. As generally used herein, the phrase "similar" refers to having 20% or less by volume, "substantially similar" refers to having 10% or less by volume, "essentially similar" means less than 5% by volume and "completely similar" means less than 1% by volume.

According to some aspects, the diverter block system may be configured to fit within the OEM engine system. The diverter block system may not substantially exceed the dimensions of the OEM engine. For example, the diverter block system may not exceed the dimensions of the OEM engine by more than 20% by volume, 10% by volume, 5% by volume, or 1% by volume. According to some aspects, the diverter block system may not exceed the dimensions of the OEM engine. For example, the diverter block may be located in the same and/or substantially the same OEM fuel line position after the diverter block is installed. The engine system may be modified from its original OEM configuration such that the fluid flow is redirected after the OEM inlet by the first diverter block to contact the sensor and redirected by the second diverter block to the OEM outlet and along the original OEM flow path. The diverter block system may be configured to use the OEM engine housing.

The diverter block system 100 comprises at least one (e.g., two) diverter blocks (110, 120), as illustrated in FIGS. 1-20. A first diverter block 110 may comprise a first opening 111, wherein a fluid enters the first diverter block 110 before the fluid exits the first diverter block 110 at a second opening 112. The second diverter block 120 may comprise a first opening 121 and a second opening 122, wherein the fluid enters the first opening 121 after the fluid exited the second opening 112 of the first diverter block 110. After entering the first opening 121 of the second diverter block 120, the fluid may exit the second diverter block 120 from the second opening 122 of the second diverter block 120.

As illustrated in FIGS. 2-4B, according to some aspects, the first opening 111 of the first diverter block 110 may be connected, directly or indirectly, to a downstream opening 210 of a fluid line adapter 200 with the upstream opening 220 connecting, directly or indirectly, to a downstream opening of an OEM fuel line 300. The second opening 122 of the second diverter block 120 may be connected, directly or indirectly, to an upstream opening 220 of a fluid line adapter 200 with a downstream opening 225 connecting, directly or indirectly, to an OEM line 310 without use of an external line between the fluid line 300 and the first diverter block 110 or the second diverter block 120.

Figure 2:
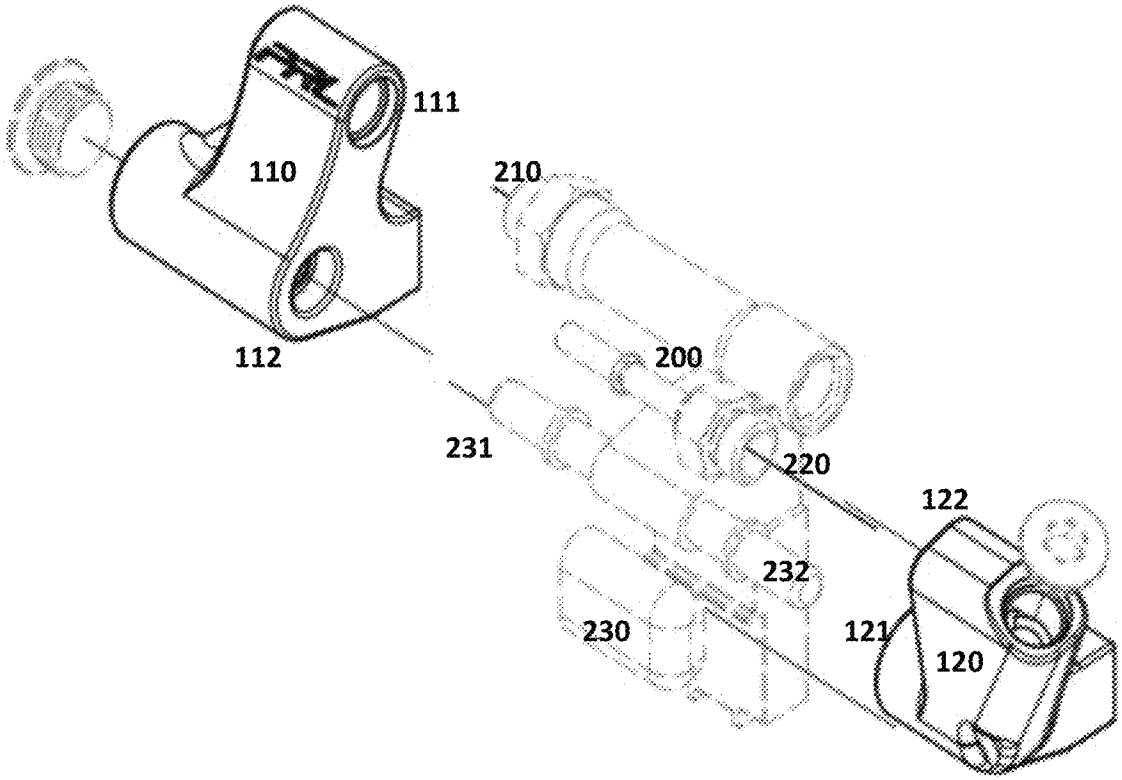
FIG. 2 includes a front exploded view of the system for redirecting a flow of a fluid according to the present invention.

According to some aspects, a sensor 230 may comprise a first opening 231 and a second opening 232, as illustrated in FIG. 2, wherein the sensor 230 may receive the fluid into the first opening 231 of the sensor 230 after the fluid exits the second opening 112 of the first diverter block 110 and the fluid may enter the first opening 121 of the second diverter block 120 after exiting the second opening 232 of the sensor 230 without use of an external line between the sensor 230 and the first diverter block 110 or the second diverter block 120. According to some aspects, the sensor 230 may comprise a commercially available sensor and/or non-OEM sensor.

Figure 3:
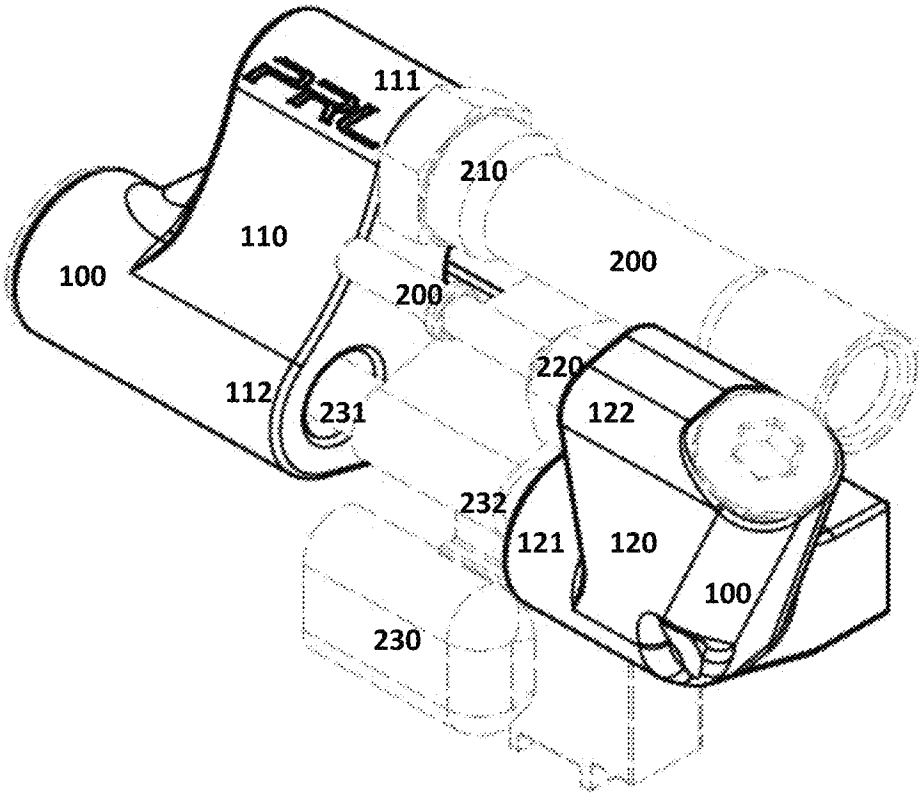
FIG. 3 includes an isometric view of the system for redirecting a flow of a fluid according to the present invention.
Figure 4A:
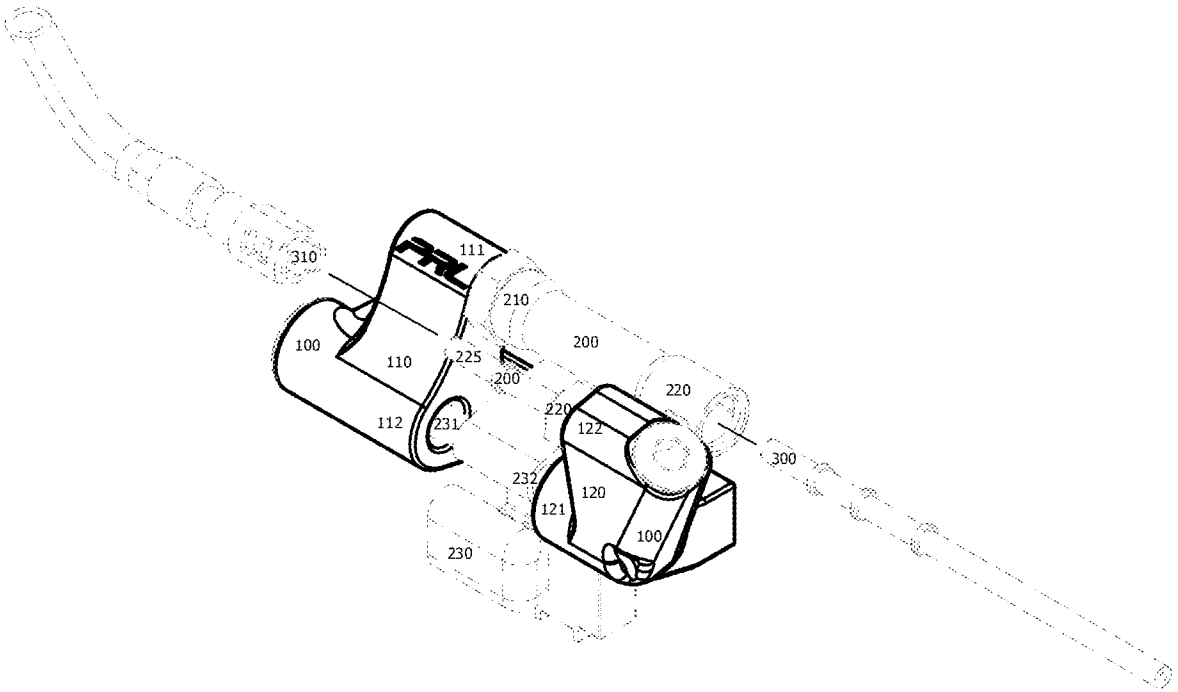
FIGS. 4A and 4B includes an isometric view of the system for redirecting a flow of a fluid according to the present invention.
Figure 4B:
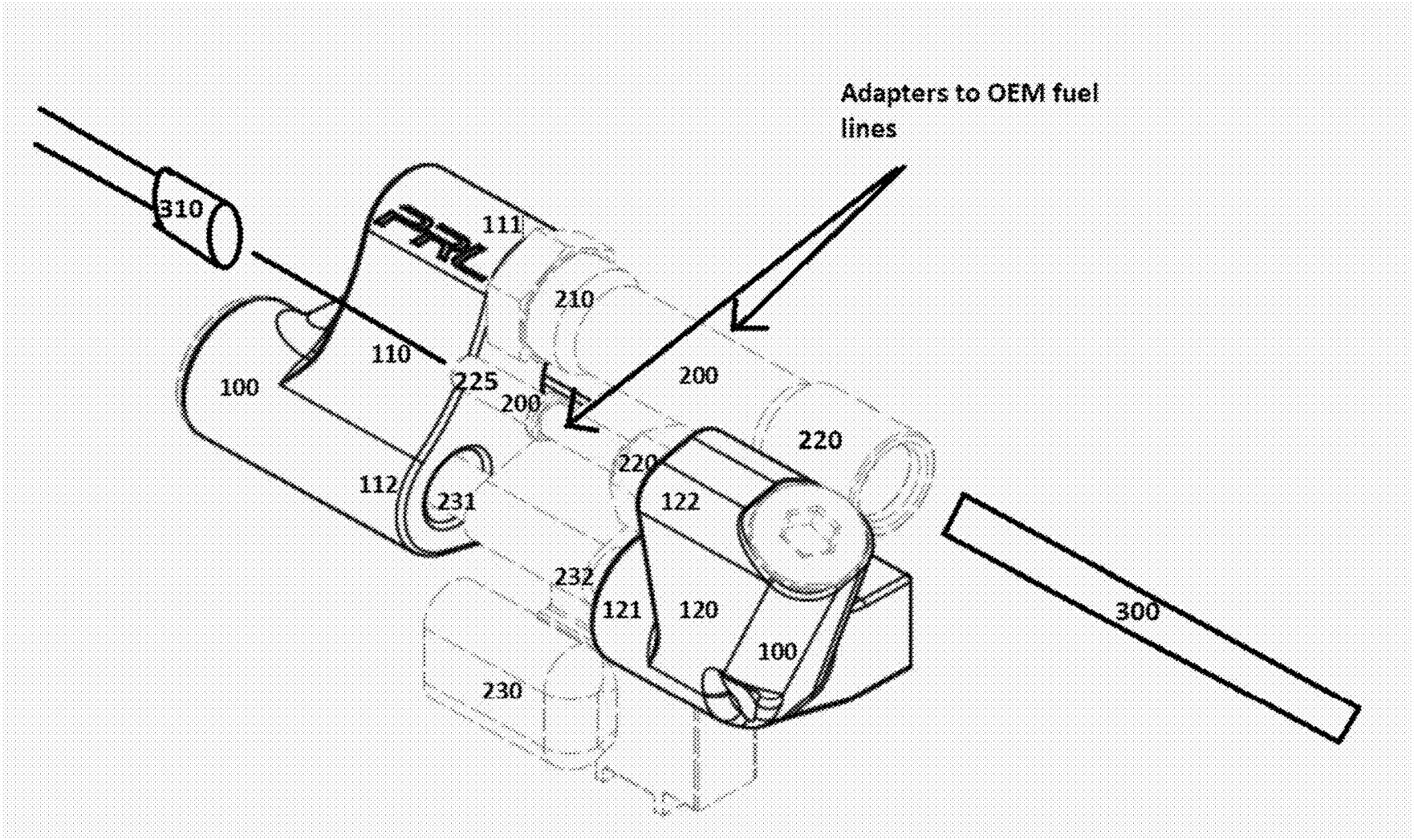
Figure 5:
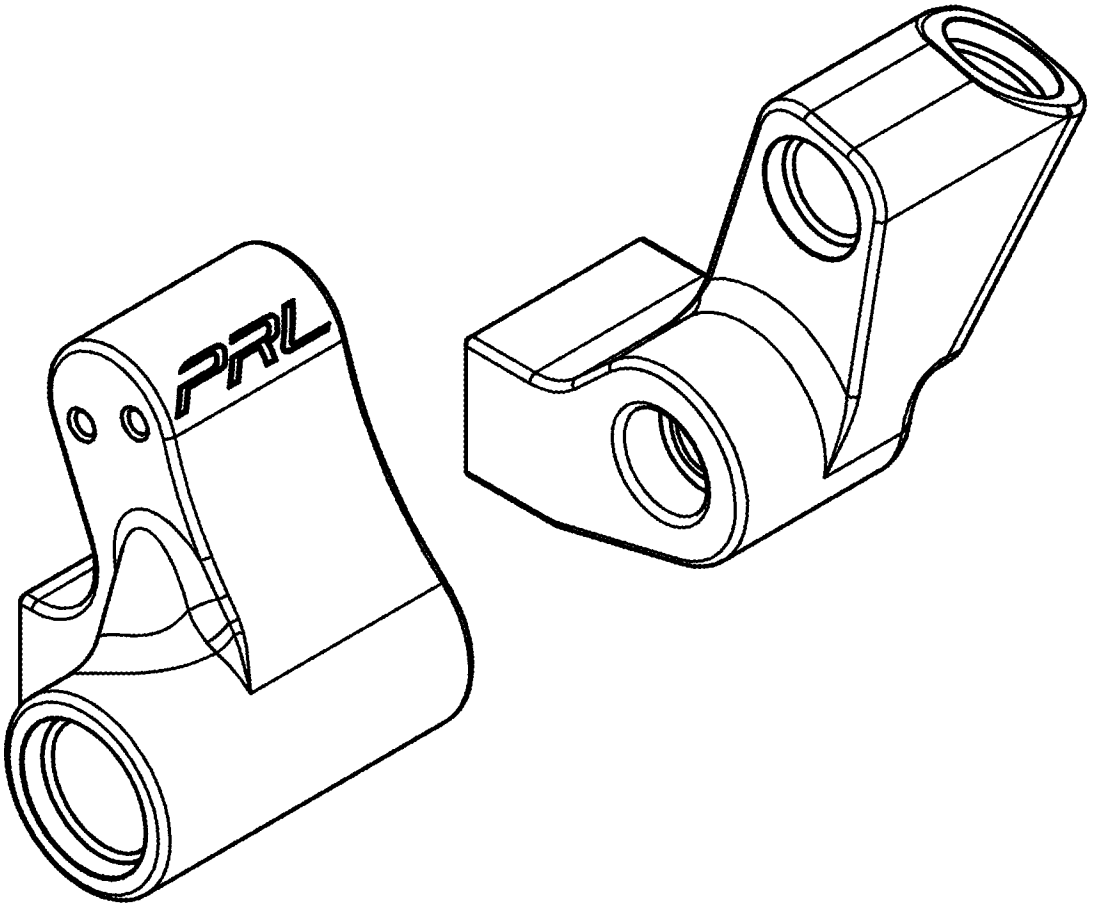
FIG. 5 includes a front perspective exploded view of a system for redirecting a flow of a fluid according to the present invention.
Figure 6:
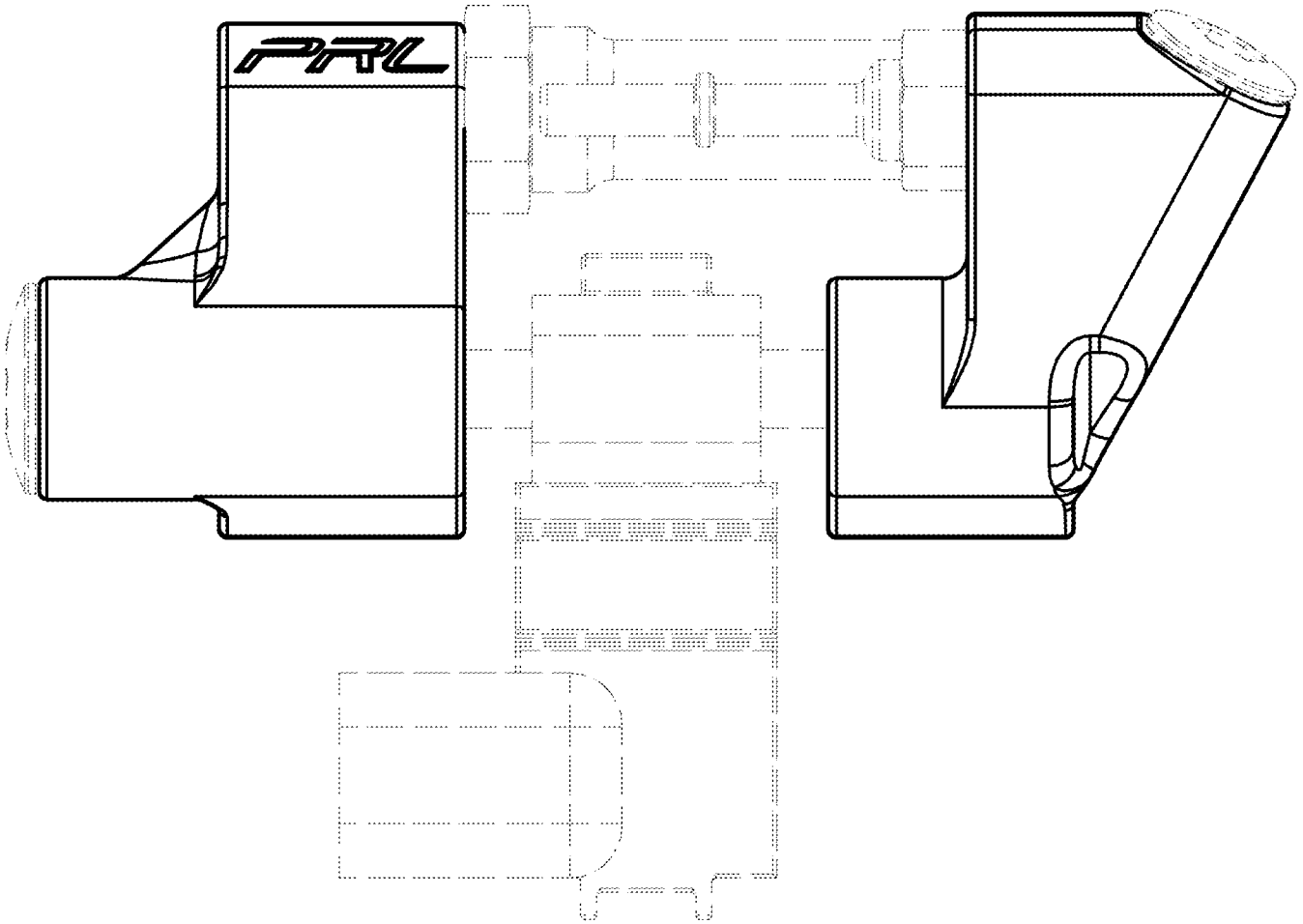
FIG. 6 includes a front view of the system for redirecting a flow of a fluid according to the present invention.
Figure 7:
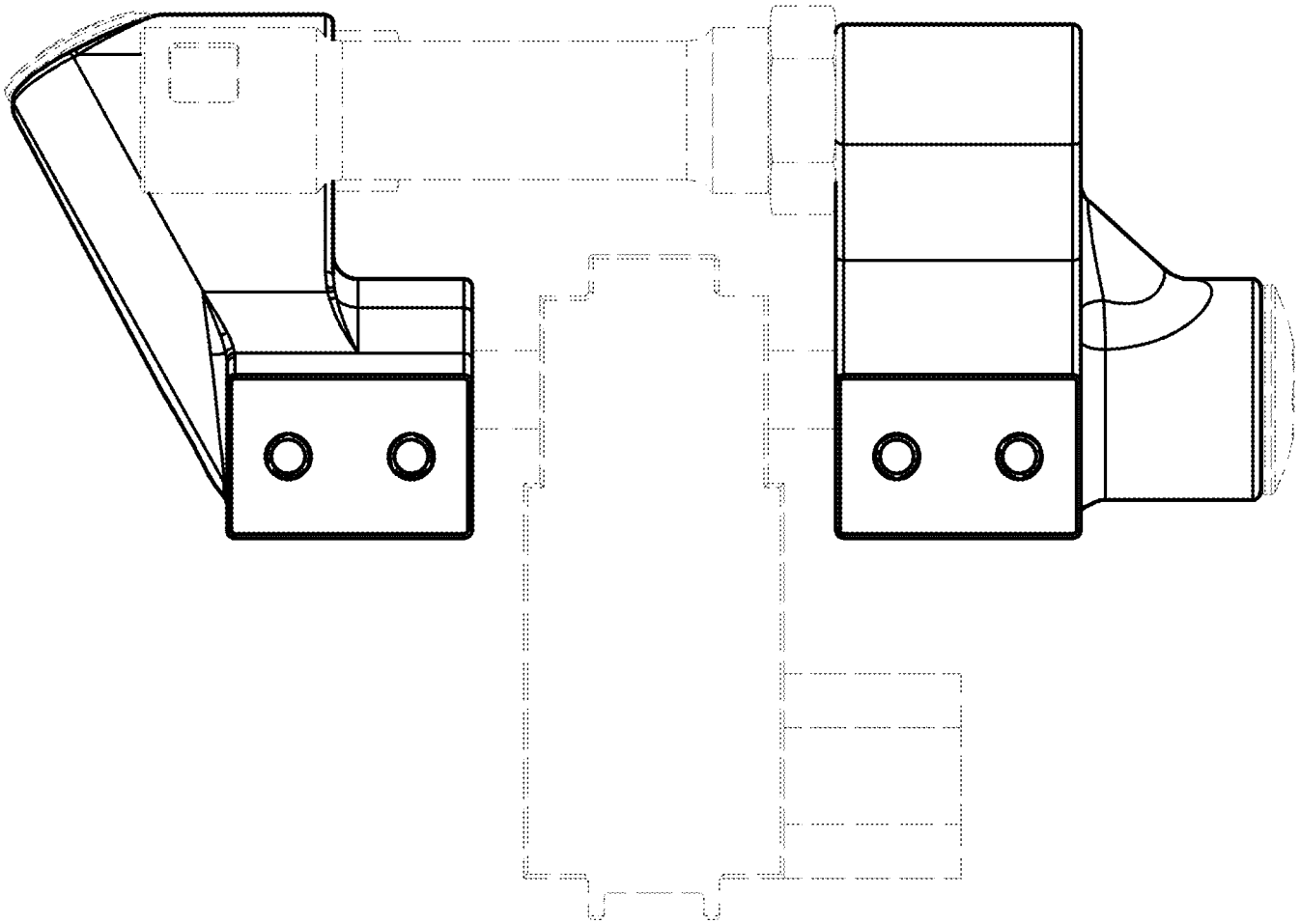
FIG. 7 includes a rear view of the system for redirecting a flow of a fluid according to the present invention.
Figure 8:
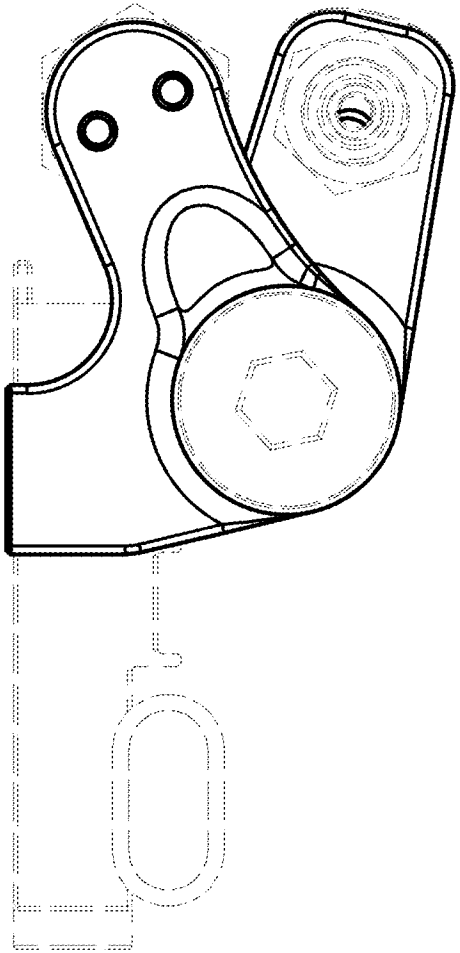
FIG. 8 includes a top view of the system for redirecting a flow of a fluid according to the present invention.
Figure 9:
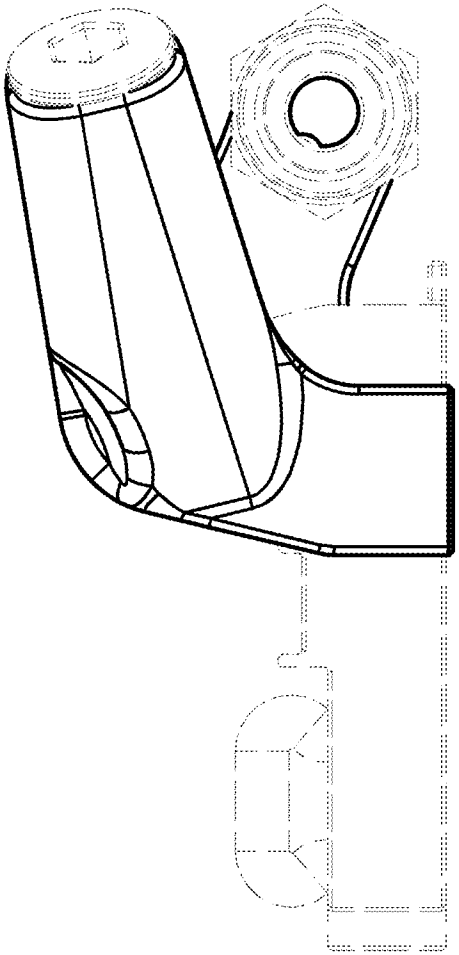
FIG. 9 includes a bottom view of the system for redirecting a flow of a fluid according to the present invention.
Figure 10:
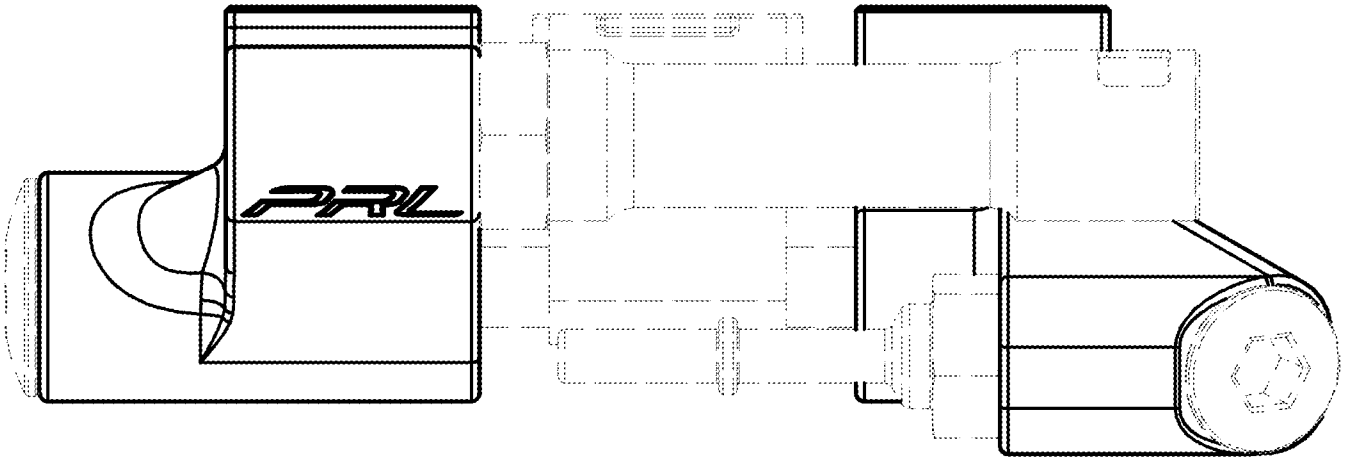
FIG. 10 includes a left side view of the system for redirecting a flow of a fluid according to the present invention.
Figure 11:
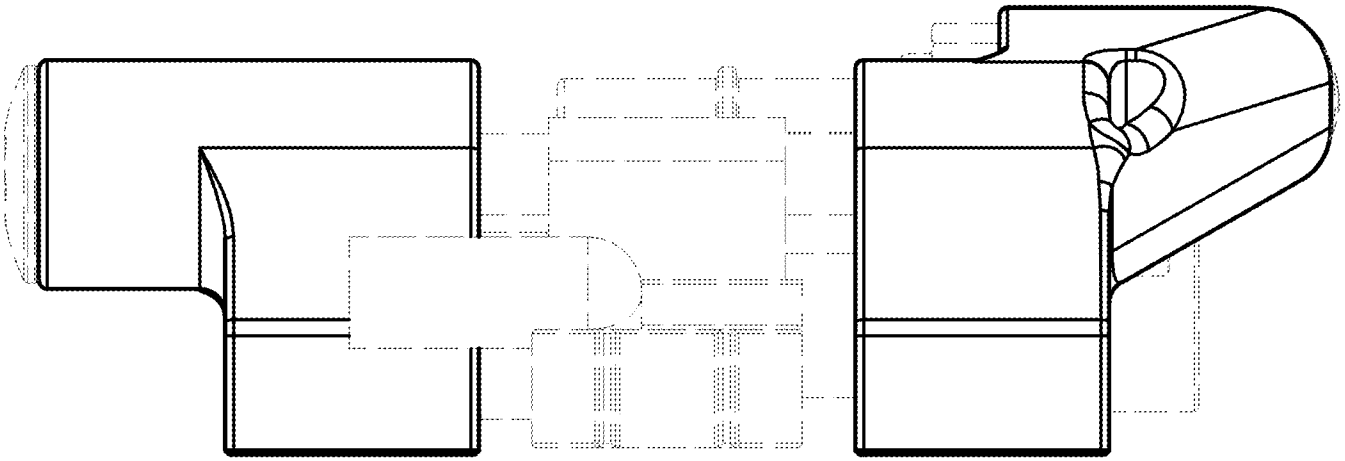
FIG. 11 includes a right side view of the system for redirecting a flow of a fluid according to the present invention.
Figure 12:
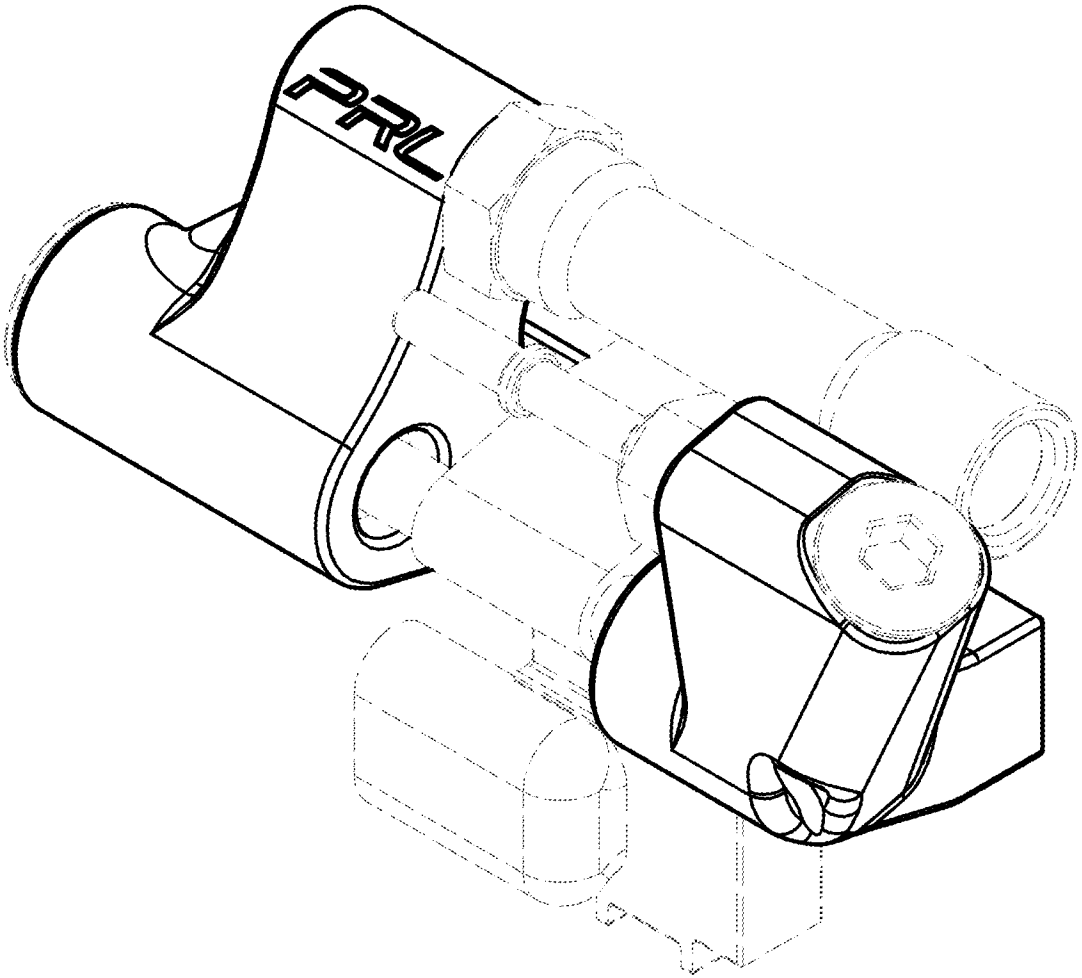
FIG. 12 includes an isometric view of the system for redirecting a flow of a fluid according to the present invention.
Figure 13:
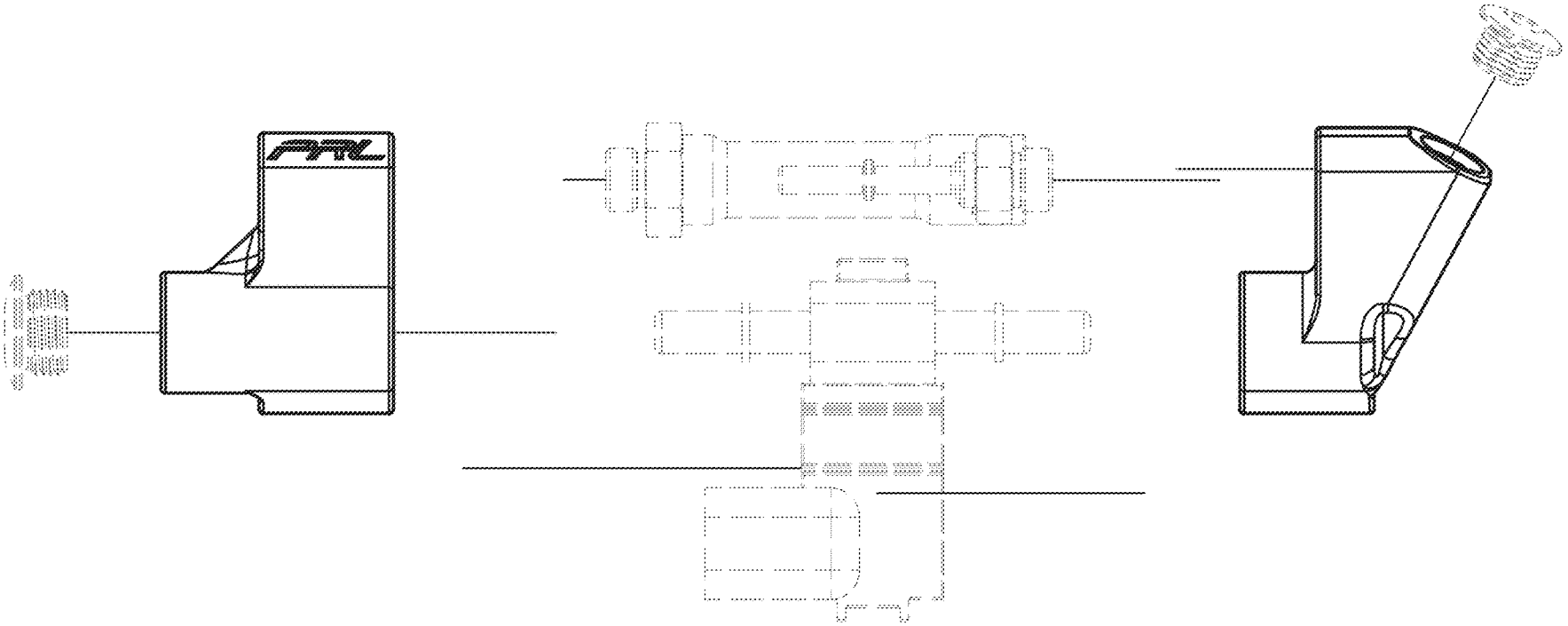
FIG. 13 includes a front exploded view of the system for redirecting a flow of a fluid according to the present invention.
Figure 14:
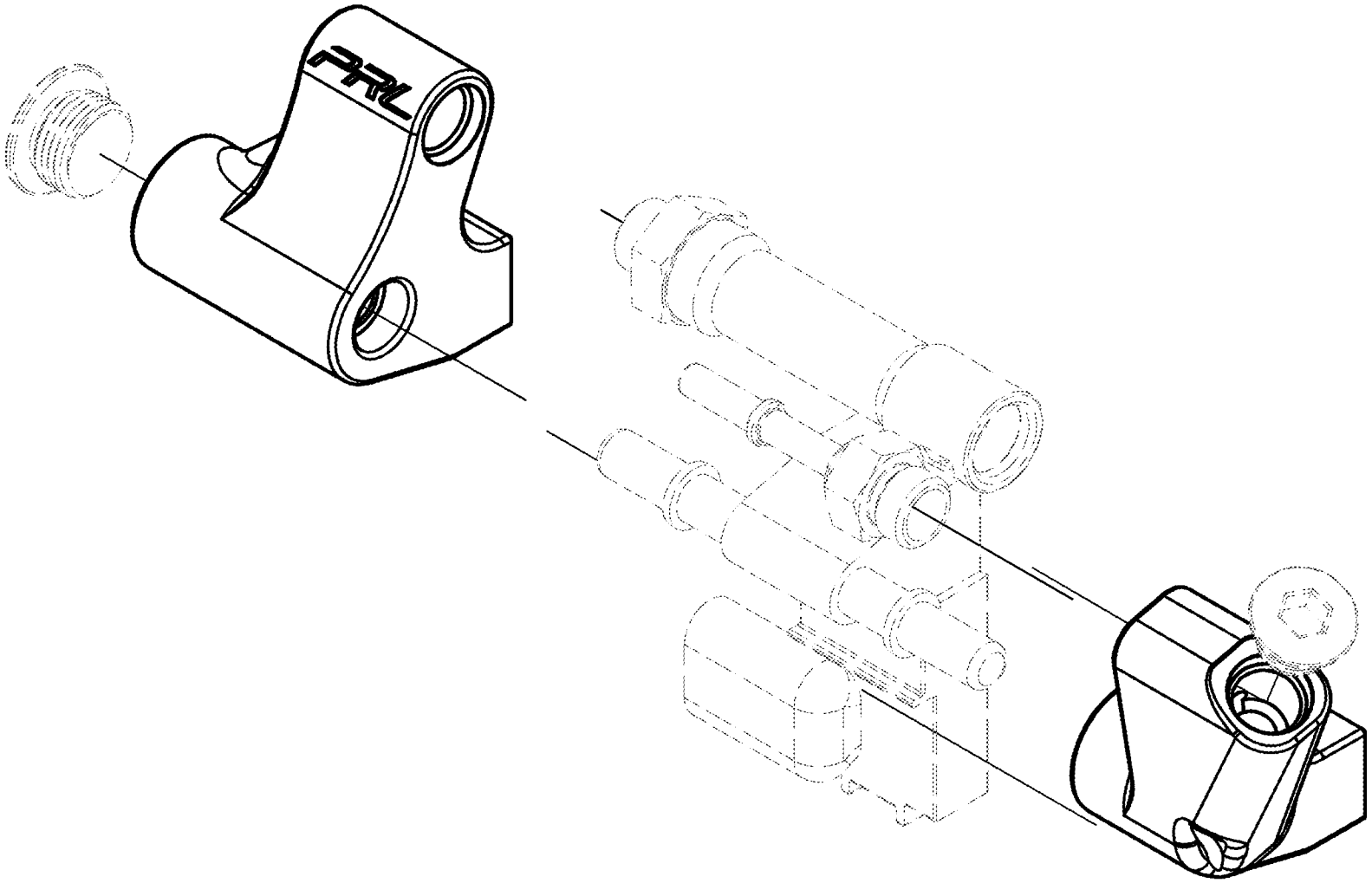
FIG. 14 includes an isometric exploded view of the system for redirecting a flow of a fluid according to the present invention.
Figure 15:
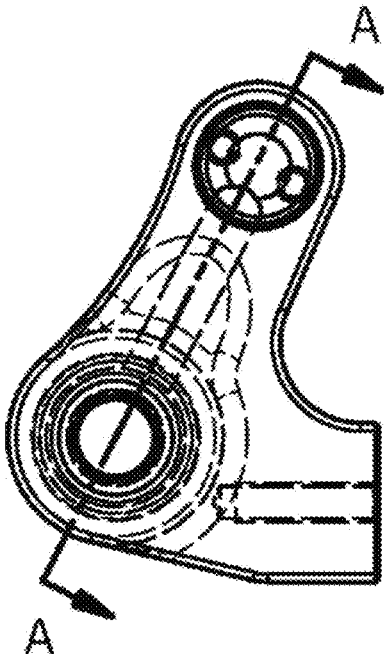
FIG. 15 includes a cross-sectional view of the system for redirecting a flow of a fluid according to the present invention.
Figure 16:
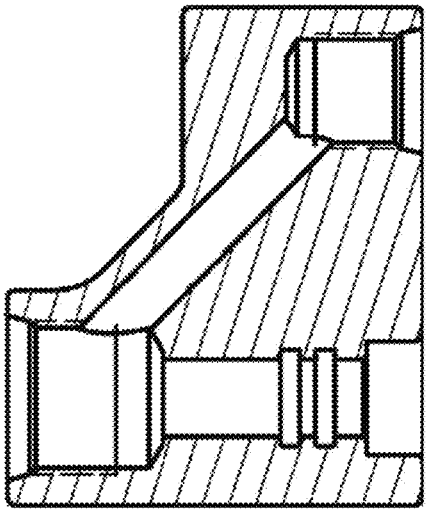
FIG. 16 includes a cross-sectional view along the line A-A of the system for redirecting a flow of a fluid according to the present invention.
Figure 17:
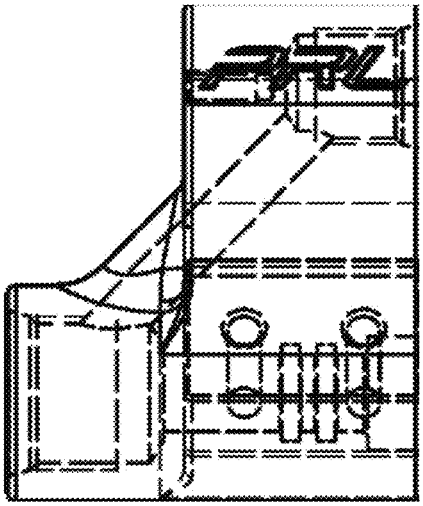
FIG. 17 includes a cross-sectional view of the system for redirecting a flow of a fluid according to the present invention.
Figure 18:
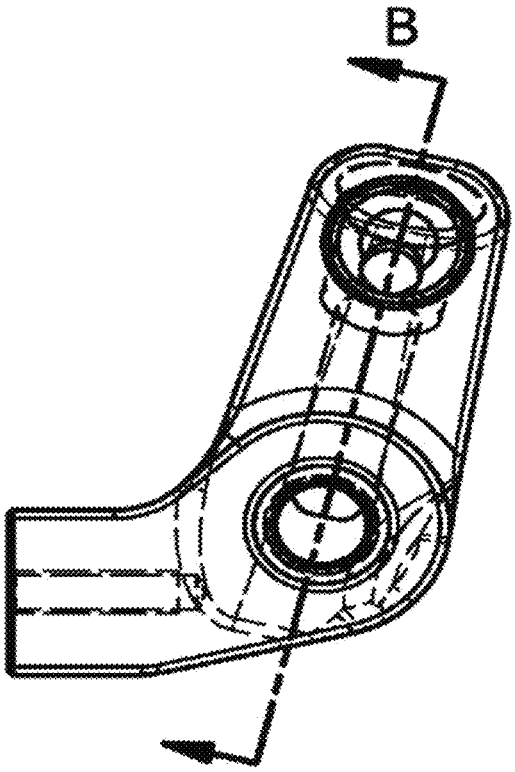
FIG. 18 includes a cross-sectional view of the system for redirecting a flow of a fluid according to the present invention.
Figure 19:
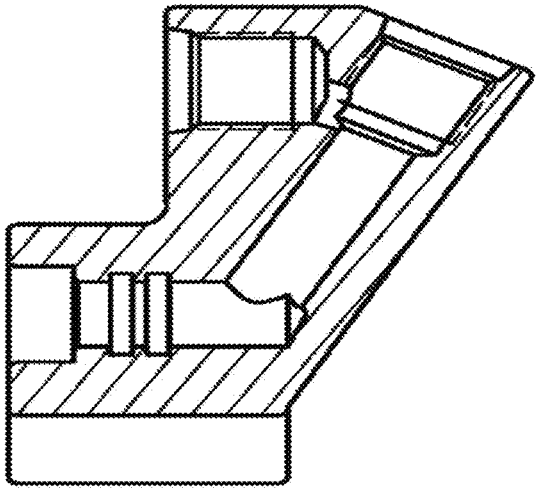
FIG. 19 includes a cross-sectional view along the line B-B of the system for redirecting a flow of a fluid according to the present invention.
Figure 20:
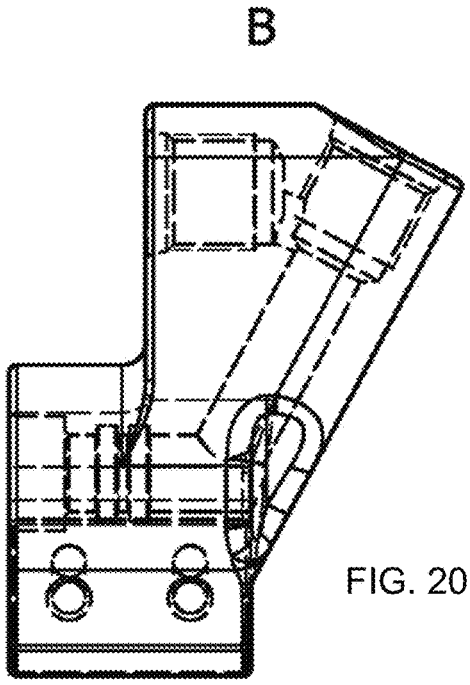
FIG. 20 includes a cross-sectional view of the system for redirecting a flow of a fluid according to the present invention.

According to some aspects, the first diverter block 110 and the second diverter block 120 may provide structural support to the sensor 230, as depicted in FIG. 3. According to aspects, the first diverter block 110 and the second diverter block 120 may hold the sensor 230 in a predetermined location along the fluid flow path. The structural support may be provided by the first diverter block 110 and the second diverter block 120 being made of a rigid material. According to some aspects, the first diverter block 110 and the second diverter block 120 may comprise aluminum. According to some aspects, the first diverter block 110 and the second diverter block 120 may comprise 6061 aluminum. Such materials, such as aluminum and 6061 aluminum, may provide durability advantages, as ethanol may not corrode aluminum in the way it does with OEM fuel lines.

According to some aspects, fluid may be redirected in a Z-shaped pattern though the sensor 230 by the first diverter block 110 and the second diverter block 120. FIG. 3 depicts the diverter block system 100 installed on the fluid line adapter 200 to connect the sensor 230 and structurally holding the sensor 230 in a predetermined location. Fluid flows through the fluid line adapter 200 upstream, into the first diverter block 110 through the first opening 111 of the first diverter block 110 and out the second opening 112 of the first diverter block 110. After the fluid flows out the second opening 112 of the first diverter block 110, it flows through the sensor 230 and into the first opening 121 of the second diverter block 120. After flowing into the first opening 121 of the second diverter block 120, the fluid flows out of the second opening 222 of the second diverter block and into the downstream fuel line adapter opening 220 of the fluid line 200. In other words, the engine, first diverter block, sensor, and second diverter block are in fluid communication. The flow path of the fuel may comprise an engine outlet, the first diverter block, sensor, second diverter block, and an engine inlet.

According to some aspects, the fluid lines 300 and 310 may comprise OEM fuel lines of a combustion engine. According to some aspects, the fluid is a fuel.

A method of redirecting a flow of a fluid may comprise providing a first diverter block 110 having a first 111 and a second 112 opening and providing a second diverter block 120 having a first 121 and second opening 122, wherein the fluid enters the first diverter block 110 through the first opening 111 of the first diverter block 110 and exits through the second opening 112 of the first diverter block 110, and wherein the fluid enters the first opening 121 of the second diverter block 120 after the fluid exits the second opening 112 of the first diverter block 110 and exits the second diverter block 120 through the second opening 122 of the second diverter block 120.

According to some aspects, the first opening 111 of the first diverter block 110 may be directly connected to a downstream opening 210 of a fluid line adapter 200 and the upstream opening 220 of a fluid line adapter 200 directly connected to a downstream opening of an OEM fuel line 300. The second opening 122 of the second diverter block 120 may be directly connected to an upstream opening 220 of a fluid line adapter 200 and a downstream opening 225 of a fluid line adapter 200 directly connected to an OEM line 310 without use of an external line between the fluid line 300 and the first diverter block 110 or the second diverter block 120.

According to some aspects, a sensor 230 may comprise a first opening 231 and a second opening 232. The sensor 230 may be configured to receive the fluid after into the first opening 231 of the sensor 230 after the fluid exits the second opening 112 of the first diverter block 110 and the fluid enters the first opening 121 of the second diverter block 120 after exiting the second opening 232 of the sensor 230.

The first diverter block 110 and the second diverter block 120 may redirect the fluid in a Z-shaped pattern through the sensor and in some aspects, provide structural support to the sensor 230 and hold the sensor 230 in a predetermined location. The first diverter block and the second diverter block may comprise aluminum, such as 6061 aluminum, for example.

According to some aspects, the first diverter block 110 and the second diverter block 120 may be installed in a combustion engine for a vehicle and the fluid line 200 may comprise an OEM fuel line. The vehicle may comprise an automobile (car, truck, SUV), motorcycle, boat, or aircraft.

According to some aspects, an adapter kit for redirecting a flow of a fluid through a sensor 230 may comprise two diverter blocks (110, 120), as illustrated in FIG. 1. A first diverter block 110 may comprise a first opening 111, wherein a fluid enters the first diverter block 110 before the fluid exits the first diverter block 110 at a second opening 112. The second diverter block 120 may comprise a first opening 121 and a second opening 122, wherein the fluid enters the first opening 121 after the fluid exited the second opening 112 of the first diverter block 110. After entering the first opening 121 of the second diverter block 120, the fluid may exit the second diverter block 120 from the second opening 122 of the second diverter block 120.

As depicted in FIG. 2, according to some aspects, the first opening 111 of the first diverter block 110 may be connected, directly or indirectly, to an upstream opening 210 of a fluid line 200 and the second opening 122 of the second diverter block 120 may be connected, directly or indirectly, to a downstream opening 220 of the fluid line 200 without the use of an external line between the fluid line 200 and the first diverter block 110 or the second diverter block 120.

According to some aspects, the sensor 230 may comprise an adapter kit having a first opening 231 and a second opening 232, as depicted in FIG. 2, wherein the sensor 230 receives the fluid (i.e., is in fluid communication) into the first opening 231 of the sensor 230 after the fluid exits the second opening 112 of the first diverter block 110 and the fluid enters the first opening 121 of the second diverter block 120 after exiting the second opening 232 of the sensor 230 without the use of an external line between the sensor 230 and the first diverter block 110 or the second diverter block 120. According to some aspects, the sensor 230 may comprise a commercially available sensor.

According to some aspects, the first diverter block 110 and the second diverter block 120 may provide structural support to the sensor 230 and hold the sensor 230 in a predetermined location. According to some aspects, the first diverter block 110 and the second diverter block 120 may comprise aluminum, such as 6061 aluminum, for example.

All documents cited herein are incorporated herein by reference, but only to the extent that the incorporated material does not conflict with existing definitions, statements, or other documents set forth herein. To the extent that any meaning or definition of a term in this document conflicts with any meaning or definition of the same term in a document incorporated by reference, the meaning or definition assigned to that term in this document shall govern. The citation of any document is not to be construed as an admission that it is prior art with respect to this application.

While particular embodiments have been illustrated and described, it would be obvious to those skilled in the art that various other changes and modifications may be made without departing from the spirit and scope of the invention. Those skilled in the art will recognize or be able to ascertain using no more than routine experimentation, numerous equivalents to the specific apparatuses and methods described herein, including alternatives, variants, additions, deletions, modifications and substitutions. This application including the appended claims is therefore intended to cover all such changes and modifications that are within the scope of this application.

What is claimed is:

1. A system for redirecting a flow of a fluid in a combustion engine, the system comprising:

a first diverter block having a first and a second opening, wherein the fluid enters the first diverter block through the first opening and exits the first diverter block through the second opening; and a second diverter block having a first and a second opening, wherein the second diverter block receives fluid into the first opening of the second diverter block after the fluid exits the second opening of the first diverter block and the fluid exits the second diverter block through the second opening of the second diverter block.

2. The system of claim 1, wherein the first opening of the first diverter block is fastened to an upstream opening of a fluid line without use of an external line and the second opening of the second diverter block is fastened to a downstream opening of the fluid line without use of an external line.

3. The system of claim 1, comprising a sensor having a first and a second opening, wherein the sensor receives the fluid into the first opening of the sensor after the fluid exits the second opening of the first diverter block and the fluid enters the first opening of the second diverter block after exiting the second opening of the sensor without adding an external line between the sensor and the first or the second diverter block.

4. The system of claim 3, wherein the first and the second diverter block provide structural support to the sensor.

5. The system of claim 4, wherein the sensor is held in a predetermined location by the first and the second diverter block.

6. The system of claim 1, wherein the first and the second diverter blocks are made of aluminum.

7. The system of claim 6, wherein the first and the second diverter blocks are made out of 6061 aluminum.

8. The system of claim 3, wherein the fluid is redirected in a Z-shaped pattern through the sensor.

9. The system of claim 2, wherein the fluid line is an OEM fuel line of a combustion engine.

10. A method of redirecting a flow of a fluid, comprising:

providing a first diverter block having a first and a second opening;

providing a second diverter block having a first and second opening;

configuring the first diverter block such that the fluid enters the first diverter block through the first opening of the first diverter block and exits through the second opening of the first diverter block; and configuring the second diverter block such that the fluid enters the first opening of the second diverter block after the fluid exits the second opening of the first diverter block and exits the second diverter block through the second opening of the second diverter block.

11. The method of claim 10, wherein the first opening of the first diverter block is fastened to an upstream opening of a fluid line and the second opening of the second diverter block is fastened to a downstream opening of the fluid line without adding an external line between the fluid line and the first or the second diverter block.

12. The method of claim 11, comprising:

providing a sensor having a first and a second opening; and configuring the sensor to receive the fluid after into the first opening of the sensor after the fluid exits the second opening of the first diverter block and the fluid enters the first opening of the second diverter block after exiting the second opening of the sensor.

13. The method of claim 12, wherein the first and the second diverter block provide structural support to the sensor and hold the sensor in a predetermined location.

14. The method of claim 12, wherein the fluid is redirected in a Z-shaped pattern through the sensor.

15. The method of claim 1, wherein the first and the second diverter block are made of aluminum.

16. The method of claim 1, wherein the fluid line is an OEM fuel line of a combustion engine.

17. An adapter kit for redirecting a flow of a fluid through a sensor, comprising:

a first diverter block having a first and a second opening, wherein the fluid enters the first diverter block through the first opening and exits the first diverter block through the second opening; and a second diverter block having a first and a second opening, wherein the second diverter block receives fluid into the first opening of the second diverter block after the fluid exits the second opening of the first diverter block and the fluid exits the second diverter block through the second opening of the second diverter block.

18. The adapter kit of claim 17, wherein the first opening of the first diverter block is fastened to an upstream opening of a fluid line and the second opening of the second diverter block is fastened to a downstream opening of the fluid line without adding an external line between the fluid line and the first or the second diverter block.

19. The adapter kit of claim 17, the sensor having a first and a second opening, wherein the sensor receives the fluid into the first opening of the sensor after the fluid exits the second opening of the first diverter block and the fluid enters the first opening of the second diverter block after exiting the second opening of the sensor.

20. The adapter kit of claim 19, wherein the first and the second diverter block provide structural support to the sensor and hold the sensor in a predetermined location.

* * * * *